US006946653B2

(12) United States Patent
Weinberger et al.

(10) Patent No.: US 6,946,653 B2
(45) Date of Patent: Sep. 20, 2005

(54) METHODS AND APPARATUS FOR IMPROVED LASER DESORPTION IONIZATION TANDEM MASS SPECTROMETRY

(75) Inventors: Scot R. Weinberger, Montara, CA (US); Pete Tornatore, Newark, CA (US)

(73) Assignee: Ciphergen Biosystems, Inc., Fremont, CA (US)

( * ) Notice: Subject to any disclaimer, the term of this patent is extended or adjusted under 35 U.S.C. 154(b) by 44 days.

(21) Appl. No.: 10/184,450

(22) Filed: Jun. 26, 2002

(65) Prior Publication Data

US 2003/0098413 A1 May 29, 2003

Related U.S. Application Data

(60) Provisional application No. 60/333,909, filed on Nov. 27, 2001.

(51) Int. Cl.[7] ..... H01J 49/40

(52) U.S. Cl. ..... 250/286; 250/287; 250/282

(58) Field of Search ..... 250/286, 287, 250/282, 288

(56) References Cited

U.S. PATENT DOCUMENTS

| | | | | |
|---|---|---|---|---|
| 5,538,897 | A | | 7/1996 | Yates, III et al. |
| 5,719,060 | A | | 2/1998 | Hutchens et al. |
| 5,894,063 | A | | 4/1999 | Hutchens et al. |
| 6,017,693 | A | | 1/2000 | Yates, III et al. |
| 6,020,208 | A | | 2/2000 | Hutchens et al. |
| 6,027,942 | A | | 2/2000 | Hutchens et al. |
| 6,225,047 | B1 | | 5/2001 | Hutchens et al. |
| 6,331,702 | B1 | | 12/2001 | Krutchinsky et al. |
| 6,504,150 | B1 | | 1/2003 | Verentchikov et al. |
| 6,515,280 | B1 | | 2/2003 | Baykut |
| 2002/0175278 | A1 | | 11/2002 | Whitehouse |
| 2002/0182649 | A1 | * | 12/2002 | Weinberger et al. ..... 435/7.9 |
| 2002/0195555 | A1 | | 12/2002 | Weinberger et al. |
| 2003/0219731 | A1 | * | 11/2003 | Weinberger et al. ..... 435/5 |

FOREIGN PATENT DOCUMENTS

| | | |
|---|---|---|
| WO | WO 99/30351 | 6/1999 |

OTHER PUBLICATIONS

Bergman, "Ladder Sequencing," *EXS* 88: 133–144 (2000).
Chait et al., "Protein Ladder Sequencing," *Science* 262: 89–92 (1993).
Chemushevich et al., "Orthogonal–injection TOFMS for Analyzing Biomolecules," *Anal. Chem.* 71: 452A–461A (Jul. 1, 1991).
Chemushevich et al., "An Introduction to Quadrupole–Time–of–Flight Mass Spectrometry," *Journal of Mass Spectrometry* 36: 849–865 (2001).

(Continued)

*Primary Examiner*—Nikita Wells
*Assistant Examiner*—Anthony Quash
(74) *Attorney, Agent, or Firm*—Fish & Neave IP Group Ropes & Gray LLP; James F. Haley, Jr.; Tae Bum Shin

(57) ABSTRACT

Laser desorption/ionization tandem mass spectrometer instruments that include immediate post source collisional cooling are presented, as are analytical methods that employ such instruments to achieve increased sensitivity and ion yield. Also presented are laser desorption/ionization mass spectrometry methods that improve sensitivity and relative ion yield by combining affinity capture probes with matrices having low melting point energy absorbing molecules combined with alkali metal scavengers.

23 Claims, 7 Drawing Sheets

OTHER PUBLICATIONS

Eng et al., "An Approach to Correlate Tandem Mass Spectral Data of Peptides with Amino Acid Sequences in a Protein Database," J. Am. Soc. Mass. Spectrom. 5: 976–989 (1994).

Griffin et al., "Direct Database Searching with MALDI–PSD Spectra of Peptides," *Rapid Communications in Mass Spectrometry* 9: 1546–1551 (1995).

Henzel et al., "Identifying Proteins from Two–Dimensional Geis by Molecular Mass Searching of Peptide Fragments in Protein Sequence Databases," *Proc. Natl. Acad. Sci. USA* 90: 5011–5015 (1993).

Hutchens et al., "New Desorptin Strategies for the Mass Spectrometric Analysis of Macromolecules," *Rapid Communications in Mass Spectrometry* 7: 576–580 (1993).

James et al., "Protein Identification by Mass–Profile Fingerprinting," *Biochemical and Biophysical Research Communications* 195: 58–64 (1993).

Keough et al., "A Method for High–Sensitivity Peptide Sequencing Using Postsource Decay Matrix–assisted Laser Desorption Ionization Mass Spectrometry," *Proclamation of the National Academy of Sciences of the USA* 96: 7131–7136 (1999).

Krutchinsky et al., "Orthogonal Injection of Matrix–assisted Laser Desorption/Ionization Ions into a Time–of–flight Spectrometer Through a Collisional Damping Interface," *Rapid Communications in Mass Spectrometry* 12: 508–518 (1998).

Loboda et al., "A Tandem Quadrupole/Time–of–Flight Mass Spectrometer with a Matrix–Assisted Laser Desorption/Ionization Source: Design and Performance," *Rapid Communications in Mass Spectrometry* 14: 1047–1057 (2000).

Mann et al., "Use of Mass Spectrometric Molecular Weight Information to Identify Proteins in Sequence Databases," *Biological Mass Spectrometry* 22: 338–345 (1993).

Mann et al., "Error–Tolerant Identification of Peptides in Sequence Databases by Peptide Sequence Tags," *Anal. Chem.* 66:4390–4399 (1994).

Merchant et al., "Recent Advancements in Surface–Enhanced Laser Desorption/Ionization–Time of Flight–Mass Spectrometry," *Electropphoresis* 21(6): 1164–1177 (Apr. 2000).

Pappin et al., "Rapid Identification of Proteins by Peptide–Mass Fingerprinting," *Curent. Biology* 3(6): pp.327–332 (1993).

Roepstorff, "Characterization of Proteins by Mass Spectrometry* Invited Lecture," *The Analyst* 117: 299–303 (1992).

Yates et al., "Peptide Mass Maps: A Highly Informative Approach to Protein Identification," *Analytical Biochemistry* 214: 397–408 (1993).

* cited by examiner

METHODS AND APPARATUS FOR IMPROVED LASER DESORPTION IONIZATION TANDEM MASS SPECTROMETRY

CROSS REFERENCE TO RELATED APPLICATION

This application claims the benefit of U.S. Provisional Application No. 60/333,909, filed Nov. 27, 2001, the disclosure of which is incorporated herein by reference in its entirety.

FIELD OF THE INVENTION

This invention is in the field of chemical and biochemical analysis, and relates to improved apparatus and methods for laser desorption ionization tandem mass spectrometry.

BACKGROUND OF THE INVENTION

The advent of electrospray ionization (ESI) and matrix-assisted laser desorption/ionization (MALDI) techniques, coupled with improved performance and lower cost of mass analyzers, has in the past decade allowed mass spectrometry (MS) to take a prominent place among analytical tools used in the study of biologically relevant macromolecules, such as proteins.

For example, in a technique known as peptide mass fingerprinting, mass spectrometry is used to identify proteins purified from biological samples. Identification is effected by matching the mass spectrum of proteolytic fragments of the purified protein with masses predicted from primary sequences prior-accessioned into a database. Roepstorff, *The Analyst* 117:299–303 (1992); Pappin et al., *Curr. Biol.* 3(6):327–332 (1993); Mann et al., *Biol. Mass Spectrom.* 22:338–345 (1993); Yates et al., *Anal. Biochem.* 213:397–408 (1993); Henzel et al., *Proc. Natl. Acad. Sci. USA* 90:5011–5015 (1993); James et al., *Biochem. Biophys. Res. Commun.* 195:58–64 (1993).

Mass spectrometric techniques have also been developed that permit at least partial de novo sequencing of isolated proteins. Chait et al., *Science* 262:89–92 (1993); Keough et al., *Proc. Natl. Acad. Sci. USA*. 96:7131–6 (1999); reviewed in Bergman, *EXS* 88:133–44 (2000).

Additional analytical power has been achieved through introduction of MS/MS analysis, using fragment mass spectra obtained from either MALDI post-source decay (PSD) or collision induced dissociation (CID). Eng et al., *J. Am. Soc. Mass. Spectrom.* 5:976–989 (1994); Griffin et al., *Rapid Commun. Mass Spectrom.* 9:1546–1551 (1995); Yates et al., U.S. Pat. Nos. 5,538,897 and 6,017,693; Mann et al., *Anal. Chem.* 66:4390–4399 (1994).

MALDI time-of-flight (TOF) PSD analysis relies on metastable decay in the drift region to produce daughter ions from selected parents; as a result, the degree of fragmentation is difficult to control or predict. It also suffers from poor sensitivity and mass accuracy. Recently, Loboda et al., *Rapid Communic. Mass Spectrom.* 14:1047–1057 (2000), described a tandem quadrupole TOF mass spectrometer having a MALDI source, which brings the advantages of CID MS/MS analysis to MALDI-sourced samples.

Further improvement in the mass spectrometric study of complex inhomogeneous biological samples has come from the development of affinity capture laser desorption ionization (LDI) approaches. Hutchens et al., *Rapid Commun. Mass Spectrom.* 7: 576–580 (1993); U.S. Pat. Nos. 5,719,060, 5,894,063, 6,020,208, 6,027,942, and 6,225,047.

In affinity capture LDI, laser desorption probes are used that have an affinity reagent on at least one surface. The affinity reagent adsorbs desired analytes from heterogeneous samples, concentrating them on the probe surface in a form suitable for subsequent laser desorption ionization. The direct coupling of adsorption and desorption of analyte obviates off-line purification approaches, permitting analysis of smaller initial samples and further facilitating sample modification approaches directly on the probe surface prior to mass spectrometric analysis.

Merchant et al., *Electrophoresis* 21:1164–1167 (2000), describe a tandem quadrupole/time-of-flight mass spectrometer adapted to use affinity capture probes, coupling high mass accuracy CID MS/MS analysis to affinity capture laser desorption ionization probe techniques.

The MALDI and affinity capture LDI tandem mass spectrometers described, respectively, in Loboda et al. and Merchant et al., extract ions orthogonally into the time of flight detector. Orthogonal extraction serves to decouple the desorption process from the mass analysis, which makes calibration simpler and more stable, sample handling more flexible, and provides other advantages over parallel (axial) injection, even in single MS mode.

However, in contrast to parallel ion extraction geometries, for which ions need survive only on the order of 10–300 microseconds before TOF analysis and detection, orthogonal acceleration TOF requires the formation of ions that must survive for at least 2–3 msec prior to TOF analysis and ultimate detection. See Krutchinksy et al., *Rapid Commun. Mass Spectrometry,* 12: 508–518 (1998); Chernushevich et al., "Orthogonal-Injection TOFMS for Analyzing Biomolecules", *Anal. Chem.* 71, 452A–461A (Jul. 1, 1991).

For various biopolymers such as proteins and peptides, ion stability, and thus ultimate survival time, depends on a number of factors, including:

(1) nascent bond energies of amino acid residues and other constituents;

(2) initial thermal energies of desorption;

(3) initial thermal energies of ionization;

(4) energies and frequency of post desorption collisions; and (5) gas phase reactions following desorption/ionization.

The nascent bond energies being inherent in the biomolecule to be analyzed, there is thus a need in the art for apparatus and methods that increase ion survival times by reducing the initial thermal energies of desorption, reducing the initial thermal energies of ionization, decreasing the energies and frequencies of post desorption collisions, and/or by reducing gas phase degradative reactions.

SUMMARY OF THE INVENTION

The present invention solves these and other needs in the art by providing, in a first aspect, an analytical instrument that comprises a laser desorption ionization source, a probe interface, and a tandem mass spectrometer. Collisional cooling is effected directly in the probe interface, before ion introduction into the tandem mass spectrometer; this immediate post-source collisional cooling dramatically improves sensitivity and ion yield, likely by increasing ion stability.

The probe interface includes a bulkhead, and the probe interface is capable of positioning a laser desorption/ionization probe in interrogatable relationship to the laser source and concurrently for ion flow through an aperture in the bulkhead into the tandem mass spectrometer. To effect immediate post-source collisional cooling, the probe interface further includes means for introducing a gas directly between the laser interrogated surface of a probe so positioned and the interface bulkhead.

In one embodiment, the probe interface further includes a probe holder, the probe holder being capable of engaging a laser desorption/ionization probe and appropriately positioning the probe. In this embodiment, the gas introducing means is capable of introducing a gas between the probe holder and the bulkhead. In a further embodiment, the bulkhead is an electrostatic lens that facilitates ion introduction into the mass spectrometer. In this latter embodiment, the gas introducing means is capable of introducing a gas between the probe holder and the electrostatic lens.

In yet a further embodiment, at present preferred, the probe holder is capable of sealingly engaging a surface of the electrostatic lens. With a probe engaged in the probe holder, sealing engagement of the probe holder to the electrostatic lens defines a space bounded by the probe holder, the laser interrogatable surface of the probe, and the electrostatic lens, and the gas introducing means is capable of introducing a gas into this bounded space.

The tandem mass spectrometer can be selected from the group consisting of a quadrupole-TOF MS, an ion trap MS, an ion trap TOF MS, a TOF-TOF MS, a Fourier transform ion cyclotron resonance MS, with an orthogonal acceleration quadrupole-TOF MS a particularly useful embodiment.

In a second, related, aspect, the invention provides a method of analyzing an analyte present on a laser desorption/ionization probe, the method comprising: desorbing and ionizing the analyte; introducing the desorbed ions into a tandem mass spectrometer; and then performing a mass spectrometric analysis on at least one of the introduced ions, or at least one fragment thereof. The probe is first positioned for desorption and ionization of analytes presented thereon and concurrently for ion flow through an aperture in a bulkhead into the tandem mass spectrometer, and gas then introduced directly between the probe and the bulkhead.

Desorption and ionization in these methods is effected by a laser desorption ionization source, and the methods thus typically comprise the antecedent steps of: positioning the probe in interrogatable relationship to the laser desorption ionization source and concurrently for ion flow through an aperture in a bulkhead into the tandem mass spectrometer; and then introducing gas directly between the probe and bulkhead.

Positioning the probe can include engaging the probe in a probe holder, and then sealingly engaging the probe holder to the bulkhead, which can be an electrostatic lens interposed between the probe holder and the tandem mass spectrometer.

The tandem mass spectrometer used in the analytical method of this second aspect of the invention can be selected from the group consisting of a quadrupole-TOF MS, an ion trap MS, an ion trap TOF MS, a TOF-TOF MS, and a Fourier transform ion cyclotron resonance MS, with particular advantages flowing from use of an orthogonal acceleration quadrupole-TOF MS.

In both the instrument and analytical methods of the present invention, the gas to be introduced in the probe interface can be selected from the group consisting of atmospheric gas, conditioned atmospheric gas, nitrogen, and noble gases, and is introduced to a pressure of at least 1 milliTorr, and typically no more than about 1 Torr, with 10 milliTorr being typical.

In the methods of this aspect of the invention, the analyte is usefully a protein, polypeptide, or peptide, and the probe is usefully an affinity capture probe capable of binding a protein, polypeptide, or peptides.

The present inventors have further discovered that surprisingly superior results can be obtained in laser desorption ionization mass spectrometry, likely by increasing ion stability, by cocrystallizing the analyte with (i) a low melting point energy absorbing molecule, and (ii) a molecule capable of scavenging alkali metals.

In a first embodiment, the energy absorbing molecule has a melting point of no more than about 210° C. In other embodiments, the energy absorbing molecule has a melting point of no more than about 200° C., and in others a melting point of no more than about 160° C. In an embodiment that is presently preferred, the energy absorbing molecule is 2,6-dihydroxyacetophenone.

The alkali metal scavenger can usefully be an ammonium salt of an organic acid, such as diammonium hydrogen citrate ammonium tartrate. A combination of 2,6-dihydroxyacetophenone and diammonium hydrogen citrate is preferred.

The foregoing aspects of the invention can be combined to provide a method of analyzing an analyte that comprises: adsorbing the analyte to an affinity capture laser desorption/ionization probe; cocrystallizing said analyte with (i) a low melting point energy absorbing molecule, and (ii) a molecule capable of scavenging alkali metals, positioning the probe in interrogatable relationship to a laser desorption ionization source and concurrently in ionic flow communication with a tandem mass spectrometer; introducing gas directly between the positioned probe and the tandem mass spectrometer; and then performing a mass spectrometric analysis on at least one of the introduced ions, or at least one fragment thereof.

BRIEF DESCRIPTION OF THE DRAWINGS

The above and other objects and advantages of the present invention will be apparent upon consideration of the following detailed description taken in conjunction with the accompanying drawings, in which like characters refer to like parts throughout, and in which.

DETAILED DESCRIPTION OF THE INVENTION

Figure 1:
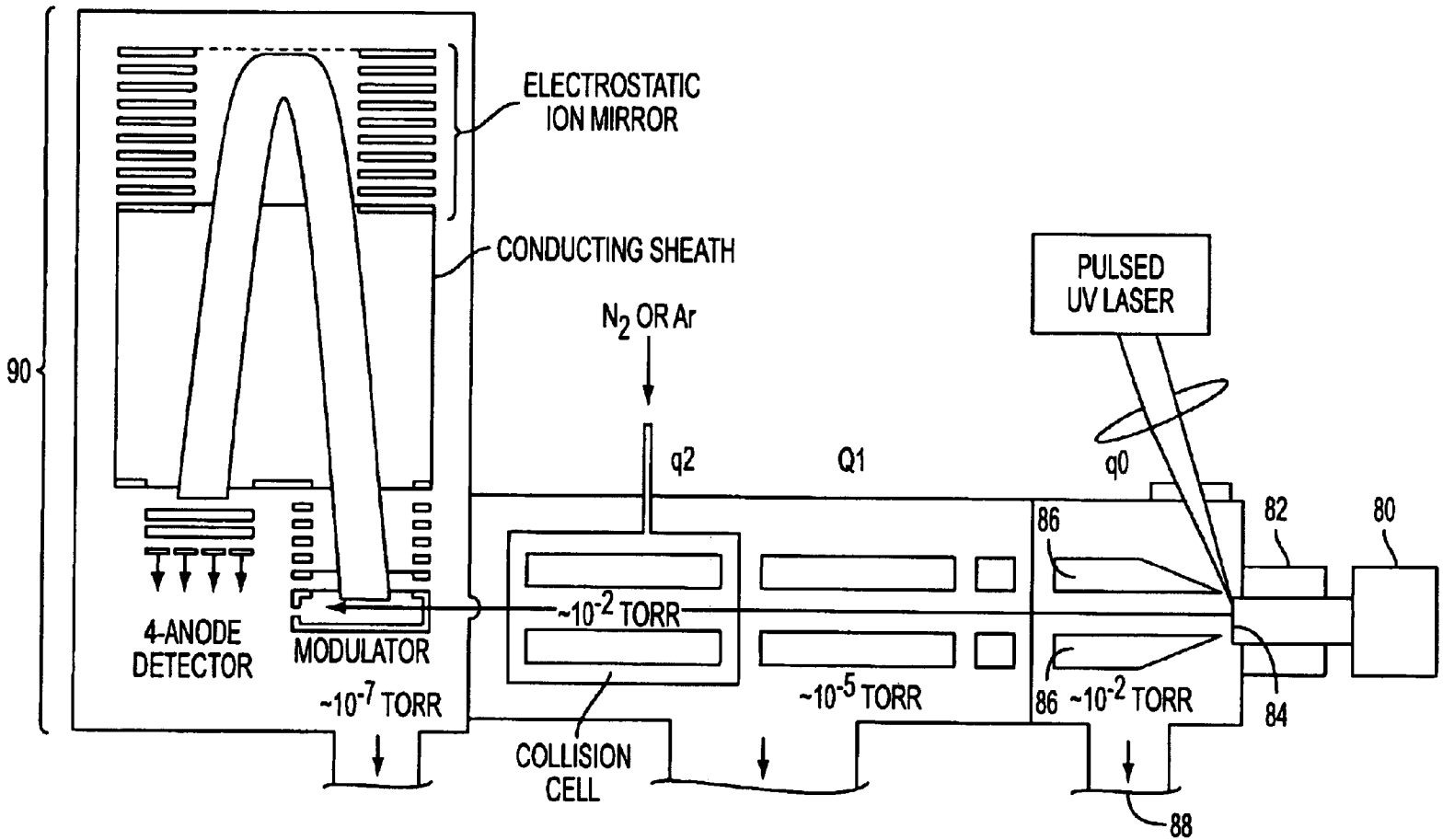
FIG. 1 (PRIOR ART)
FIG. 1 schematizes a prior art OA-QqTOF mass spectrometer with MALDI source.

Orthogonal extraction, by uncoupling the time of flight measurement from ion formation, offers a number of significant advantages over axial extraction approaches in laser desorption time-of-flight mass spectrometers.

For example, laser fluence-related problems, such as peak broadening due to ion shielding and ion acceleration field collapse, are eliminated because ions of the desorption plume have an extended period of time (typically a few milliseconds) to expand and cool prior to orthogonal extraction and acceleration into the TOF mass analyzer.

Additionally, orthogonal extraction eliminates much of the large hump and baseline anomaly seen at the beginning of high laser energy, conventional extraction spectra due to the chemical noise created by the excessive neutral load of the energy absorbing molecules (EAM) of the matrix. Because neutrals are not extracted to enter the TOF analyzer, only ions are transmitted down to the detector and chemical noise is appreciably reduced.

These factors allow the use of laser fluences that are 2–3 times greater than those normally employed during parallel continuous or delayed ion extraction approaches. The net result is an almost complete elimination of the need to hunt and search for "sweet spots" even in the presence of poor sample-EAM homogeneity, as well as improved external standard mass accuracy determination (typical errors are between 20–50 ppm), improved quantitative reproducibility, and improved signal to noise.

An additional benefit is the elimination of the need to perform low and high laser energy scans to analyze ions of a broad m/z range. A single laser fluence can be employed to see both low and high mw ions, greatly simplifying the analysis of unknown mixtures.

Perhaps one of the most impressive advantages of orthogonal extraction when compared to conventional parallel extraction approaches lies in its ability to obviate the rigid sample positioning requirements of parallel extraction devices. Because the TOF measurement is substantially removed from the ion formation process, the original position of the ion is no longer important. Simple 2-dimensional sample manipulators can be employed while still maintaining excellent, external-standard mass accuracy performance.

However, in contrast to parallel ion extraction geometries, for which ions need survive only on the order of only 10–300 microseconds before TOF analysis and detection, orthogonal acceleration TOF requires the formation of ions that must survive for at least 2–3 msec prior to TOF analysis and ultimate detection. See Krutchinksy et al., *Rapid Commun. Mass Spectrometry,* 12: 508–518 (1998); Chernushevich et al., "Orthogonal-Injection TOFMS for Analyzing Biomolecules", *Anal. Chem.* 71, 452A–461A (Jul. 1, 1991).

The present inventors have discovered that significant improvement in ion stability—with a concomitant dramatic improvement in sensitivity and relative ion yield in experiments performed using an OA-QqTOF tandem mass spectrometer—can be achieved by effecting collisional cooling directly at the laser interrogated surface of the laser desorption/ionization probe, before ion introduction into the first RF quadrupole of the tandem mass spectrometer. Surprisingly, the effect appears to be achieved without requiring change in the ambient pressure at the desorption surface.

In a first aspect, therefore, the invention provides an analytical instrument that incorporates immediate post-source collisional cooling. In a second, related, aspect, the invention provides analytical methods that include such immediate post-source collisional cooling.

Collisional cooling of laser desorbed ions in the first quadrupole ion guide of OA-QqTOF mass spectrometers has been described.

For example, WO 99/30351 teaches that collisional cooling in the quadrupole ion guide that couples an ESI source to the mass analyzers facilitates focusing of ions onto the quadrupole axis after damping of initial velocities.

As another example, FIG. 1 is a schematic of an orthogonal acceleration tandem quadrupole/time-of-flight mass spectrometer adapted to accept a matrix-assisted laser desorption/ionization (MALDI) source, as described in Loboda et al., *Rapid Communic. Mass Spectrom.* 14:1047–1057 (2000).

In this device, samples are introduced on the tip of MALDI probe 80 inserted through a vacuum lock 82. Probe tip 84 is positioned about 4 mm from the entrance of RF quadrupole ion guide 86 ("q0"), and held at a potential of about 30 to 200 V above ground. As indicated in FIG. 1, the pressure in this region is typically on the order of about 10 mTorr, which pressure is maintained by a pump communicably attached to outlet 88. The background gas present in q0 is sufficient to effect collisional cooling of ions desorbed and ionized from probe tip 84.

Collisional cooling in q0 of this device has been recognized to convert the pulsed MALDI beam into a quasi-continuous beam with reduced radial and axial velocity distributions, suitable for introduction into quadrupole mass filter "Q1" and subsequent orthogonal injection into TOF mass analyzer 90. Loboda et al., *Rapid Communic. Mass Spectrom.* 14:1047–1057 (2000).

The present inventors have discovered that significant improvements in collisional cooling can be achieved by communicably segregating the laser desorption probe from q0 and introducing cooling gases into the segregated space so defined.

Figure 2:
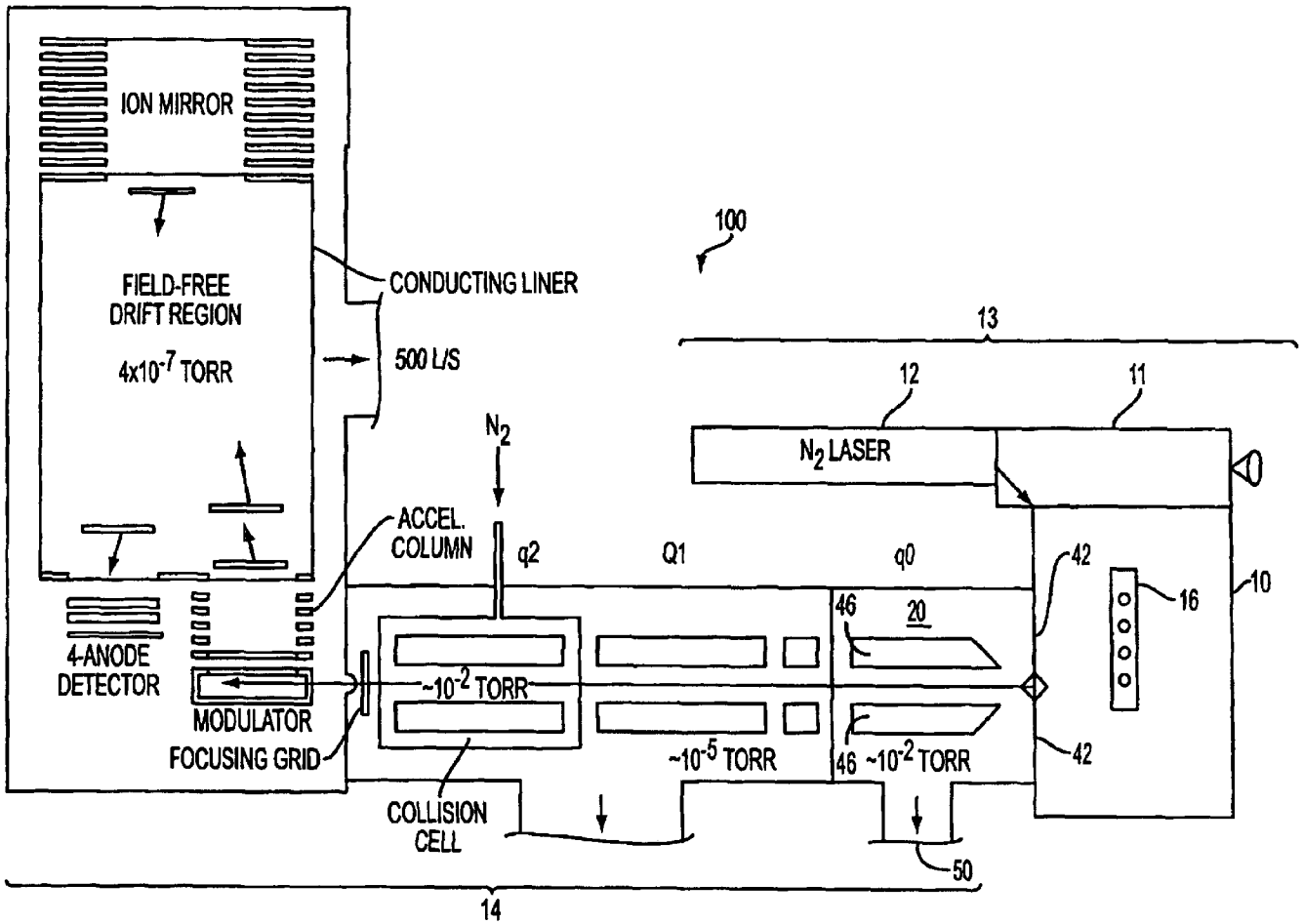
FIG. 2 schematizes an OA-QqTOF mass spectrometer having a probe interface that communicably segregates the probe from the first quadrupole ion guide of the tandem MS.

FIG. 2 shows analytical instrument 100, comprising laser desorption ionization source 13, probe interface 10, and tandem mass spectrometer 14.

Probe interface 10 segregates probe 16 from tandem mass spectrometer 14 by interposing bulkhead 42 between probe 16 and tandem mass spectrometer 14. Bulkhead 42, which has no counterpart in the device of FIG. 1, possesses an aperture that permits ion flow communication between probe 16 and tandem mass spectrometer 14.

Although probe interface 10 as shown is particularly adapted to engage and position affinity capture laser desorption/ionization probes, such as ProteinChip® Arrays (Ciphergen Biosystems, Inc., Fremont, Calif.), in other embodiments probe interface 10 can be adapted to engage and position standard MALDI probes.

As with the device shown in FIG. 1, q0 collisional cooling can be effected in the device shown in FIG. 2.

With reference to FIG. 2, the pressure in chamber 20 enclosing first quadrupole 46 (q0) of tandem mass spectrometer 14 can be on the order of about 10 mTorr, which pressure is maintained by a pump communicably attached to outlet 50. At 10 mTorr, the background gas is sufficient to effect collisional cooling in q0 of ions desorbed and ionized from probe 16.

As noted above, the aperture in bulkhead 42 permits ion communication between probe 16 and q0, and should equally permit equilibration of gas pressures as between probe interface 10 and space 20 of tandem mass spectrometer 14.

Surprisingly, however, notwithstanding the ability of pressure to equilibrate across the aperture in bulkhead 42, the present inventors have discovered that significant improvements in sensitivity and relative ion yield can be effected by introducing cooling gases into the space defined between bulkhead 42 and the laser interrogated surface of probe 16, rather than into q0.

Figure 3:
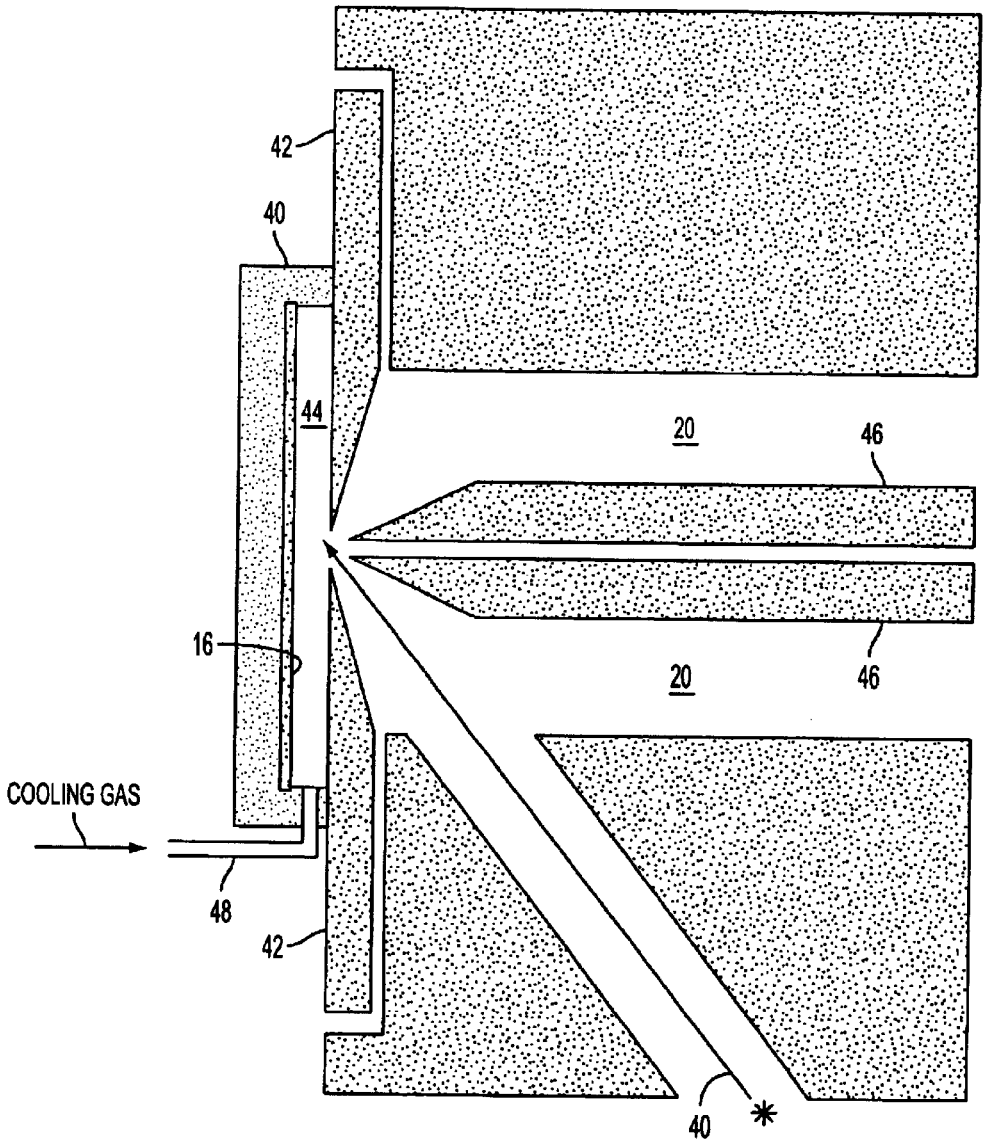
FIG. 3 is a side cross sectional view of the probe interface and first RF ion guide (q0) of an analytical instrument according to the present invention.

FIG. 3 is a side cross sectional view of a device according to the present invention, particularly showing the adjoining portions of probe interface 10 and tandem spectrometer 14.

Probe 16 is shown engaged in probe holder 40, which is itself shown sealingly engaged to bulkhead 42, which is caught twice in this side cross sectional view. As so engaged, probe holder 40, probe 16, and bulkhead 42 define and bound chamber 44.

Chamber 44 is not completely enclosed, however. Bulkhead 42 has a central aperture that permits ion and gas flow between chamber 44 and chamber 20, the latter of which chambers contains first quadrupole 46 (q0) of tandem mass spectrometer 14.

Also shown is path 40 of laser light from laser desorption source 13.

Usefully, bulkhead 42 can form a first element of an ion collection assembly that functions to collect ions desorbed within the desorption chamber of probe interface 10 and direct them towards the mass spectrometer inlet.

In such embodiments, bulkhead 42 is an extractor lens positioned between 0.2 to 4 mm from the laser interrogatable surface of probe 16, between probe 16 and first quadrupole 46 (q0) of the mass spectrometer. The extractor lens contains an aperture ranging from 2 mm to 20 mm in diameter that is concentrically located about a normal axis that extends from the center of the desorption locus to the center of the mass spectrometer inlet.

Probe 16 and holder 40 collectively can form, in these embodiments, a second element of the ion collection assembly. Independent DC potentials are applied to the first and second elements of the electrostatic assembly to drive ion flow from the probe toward the aperture of the electrostatic (extractor) lens.

Also shown are means for delivering a cooling gas directly to chamber 44 between the laser interrogatable surface of probe 16 and bulkhead (typically, electrostatic lens) 42. In the embodiment shown, the gas delivery means comprise tube 48, which is a ¼ inch OD, 1/16 inch ID tube fitted through probe holder 40.

The gas is selected from the group consisting of atmospheric gas, conditioned atmospheric gas, nitrogen, and noble gases, such as argon. Conditioning of atmospheric gas can include, e.g., removal of moisture using a moisture trap and/or removal of particulates using one or more filters of various porosity.

This immediate post-source cooling or damping of the ion population shares three major advantages with q0 collisional cooling.

First, the cooling eliminates the initial energy distributions of the desorbed ions and reduces their total energy down to a point that approximates their thermal energy. This simplifies the orthogonal extraction requirement, compensating for variations in ion position and energy, thus improving ultimate resolving power. A direct consequence of this improved resolution is enhanced mass accuracy down to the low ppm level.

The second advantage of collisional cooling is in the creation of a pseudo-continuous flow of ions into the mass analyzer. Ion collisions in q0 cause the desorption cloud to spread out along the axis of q0. This spreading creates a situation in which ions from various desorption events begin to overlap, creating an electrospray-like continuous introduction of ions into the analyzer.

The third major advantage of collisional cooling, whether at the probe surface or in first quadrupole ion guide 46 (q0), is its ability to decrease the rate of long term ion decay. Gas collisions relax internal excitation and improve the stability of peptide and protein ions. Faster decay mechanisms (prompt and in-source type decay) still occur.

In contrast to ion cooling in RF ion guide 46 (q0), however, the introduction of cooling gas directly into chamber 44 confers dramatic improvements in sensitivity and relative ion yield.

Figure 4A:
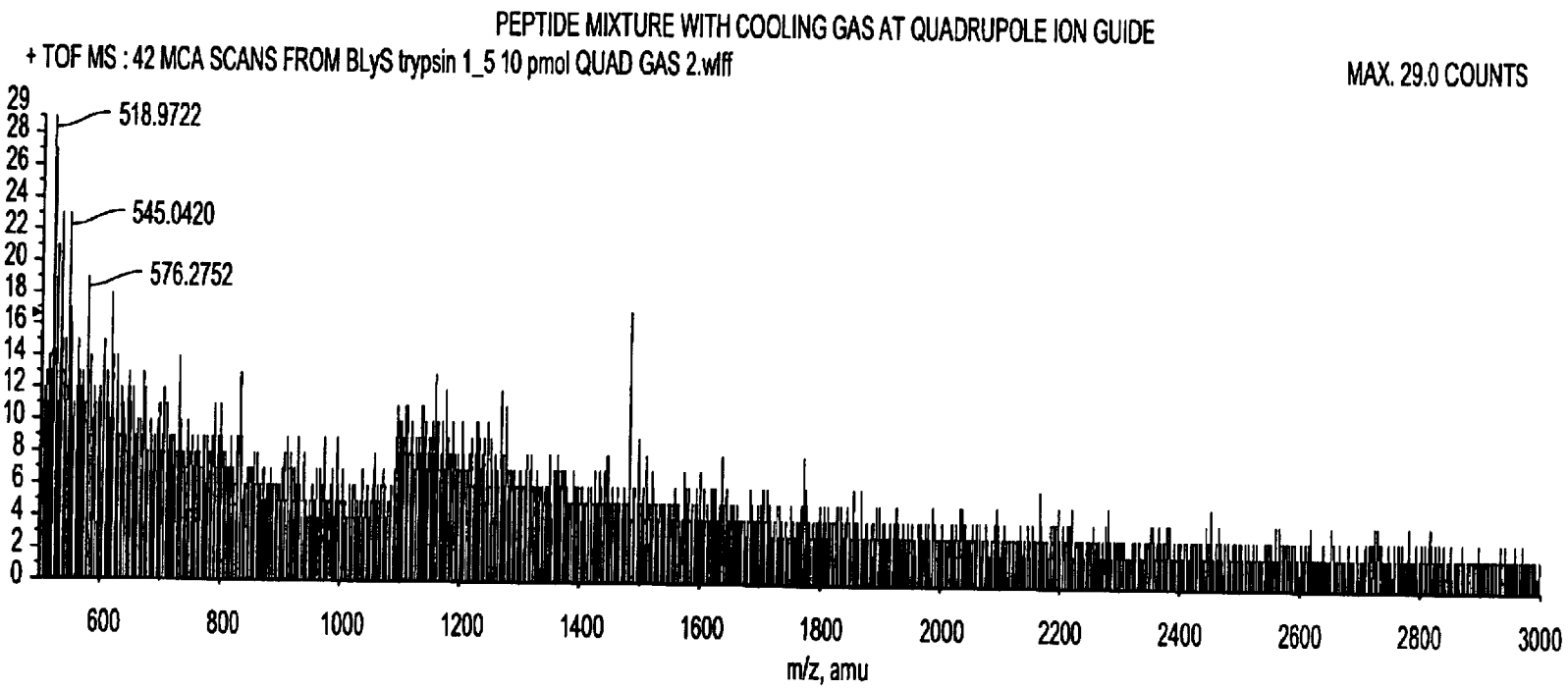
FIG. 4A is an OA-QqTOF MS scan of a peptide mixture desorbed from an affinity capture probe using an analytical instrument according to FIG. 2, with collisional cooling effected in q0.
Figure 4B:
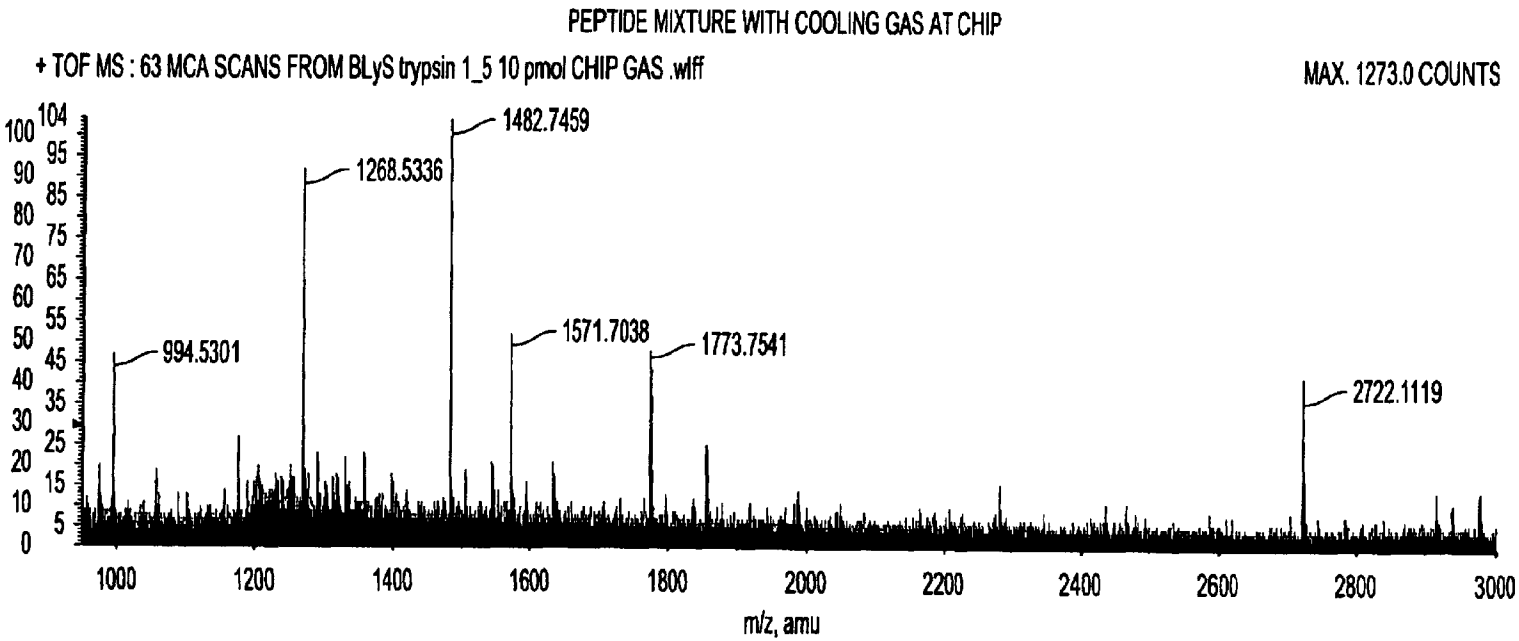
FIG. 4B is an OA-QqTOF MS scan of the same peptide mixture as analyzed in FIG. 4A desorbed from an affinity capture probe using an analytical instrument of the present invention according to FIG. 3, with immediate post-source collisional cooling.

FIG. 4A is an OA-QqTOF MS scan of a peptide mixture desorbed from an affinity capture probe using an analytical instrument according to FIG. 2. By comparison, FIG. 4B is an OA-QqTOF MS scan of the same peptide mixture as analyzed in FIG. 4A, acquired using an analytical instrument of the present invention, in which cooling gas is delivered directly to chamber 44 as depicted in FIG. 3.

As is readily seen, there is impressive increase in sensitivity and relative ion yield for ions 994, 1268, 1482, 1571, 1773, and 2722. Without intending to be bound by theory, it is believed that these improvements result from a more immediate cooling of the ions, thus substantially improving their stabilities. Secondary benefits may arise by pneumatic collection of ions as introduced gas flows from the affinity capture probe surface through the aperture of the electrostatic lens, dragging ions into q0.

Surprisingly, the increase in sensitivity and ion yield is observed without necessarily changing the total pressure surrounding the probe interrogation surface as compared to gas introduction in q0.

Gas is introduced into chamber 44 to an equilibrium pressure of at least about 1 milliTorr and no more than about 1 Torr, typically at least about 5 millitorr, often at least about 10 milliTorr, often at least about 10 millitorr, 20 mTorr, 30 mTorr, 40 mTorr, and even at least about 50 mTorr, and often no more than about 750 mTorr, often no more than about 500 mTorr, 400 mTorr, 300 mTorr, 250 mTorr, and even no more than about 100 mTorr.

As noted above, the data shown in both FIGS. 4A and 4B were obtained using an OA-QqTOF MS adapted to use an affinity capture probe.

"Affinity capture probe" (equally, "laser desorption/ionization affinity capture probe") refers to a laser desorption/ionization probe that binds analyte through an interaction that is sufficient to permit the probe to extract and concentrate the analyte from an inhomogeneous mixture. Concentration to purity is not required. The binding interaction is typically mediated by adsorption of analyte to an adsorption surface of the probe. The term "ProteinChip® Array" refers to affinity capture probes that are commercially available from Ciphergen Biosystems, Inc., Fremont, Calif., for use in the present invention.

The analytical instruments of the present invention are not limited, however, to those adapted to use affinity capture probes: the analytical instrument of the present invention can readily include probe interfaces adapted to accept and position standard MALDI probes.

Furthermore, although the data shown in FIGS. 4A and 4B were obtained using an OA-QqTOF tandem mass spectrometer, the analytical instrument of the present invention can include other types of tandem mass spectrometers, including a tandem mass spectrometer selected from the group consisting of a quadrupole-TOF MS, an ion trap MS, an ion trap TOF MS, a TOF-TOF MS, and a Fourier transform ion cyclotron resonance MS.

In a second aspect, the present invention provides methods of analyzing analytes that are present on a laser desorption/ionization probe, which methods use the analytical instrument of the present invention. In a first embodiment, the method comprises desorbing and ionizing the analyte; introducing the desorbed ions into a tandem mass spectrometer; and then performing a mass spectrometric analysis on at least one of the introduced ions, or at least one fragment thereof. Prior to these steps, the probe is first positioned for desorption and ionization of analytes presented thereon and concurrently for ion flow through an aperture of a bulkhead into the tandem mass spectrometer. Thereafter, prior to desorption and ionization, gas is introduced directly between said probe.

Desorption and ionization is effected by interrogating the spectrometer-proximal surface of the probe with a laser spot that is directed from a laser source to the probe surface by a laser optical train (see, e.g., laser optical train 11 in FIG. 2); the laser optical train focuses a beam of desired size and fluence on a desired portion of the probe surface.

Accordingly, the method typically begins by positioning the probe in interrogatable relationship to the laser desorption ionization source (typically by positioning the probe with respect to the laser optical train) and concurrently positioning the probe for ion flow through an aperture of a bulkhead into the tandem mass spectrometer. This is usefully effected by reversibly engaging probe 16 into a probe holder 40 in probe interface 10.

Probe holder 40 can then usefully be sealingly engaged to a bulkhead (typically, electrostatic lens) 42 interposed between probe holder 16 and tandem mass spectrometer 14, thus defining chamber 44, and gas introduced directly into chamber 44 formed between the laser-interrogated surface of probe 16, probe holder 40, and electrostatic lens 42.

As noted above, the tandem mass spectrometer can be selected from the group consisting of a quadrupole-TOF MS, an ion trap MS, an ion trap TOF MS, a TOF-TOF MS, and a Fourier transform ion cyclotron resonance MS, with significant advantages realized by use of an OA-QqTOF mass spectrometer. And as further noted above, the gas can be selected from the group consisting of atmospheric gas, conditioned atmospheric gas, nitrogen, and noble gases, such as argon. Conditioning of atmospheric gas can include, e.g., removal of moisture using a moisture trap and/or removal of particulates using one or more filters of various porosity.

Gas is introduced into chamber 44 to an equilibrium pressure of at least about 1 milliTorr and no more than about 1 Torr, typically at least about 5 millitorr, often at least about 10 milliTorr, often at least about 10 millitorr, 20 mTorr, 30 mTorr, 40 mTorr, and even at least about 50 mTorr, and often no more than about 750 mTorr, often no more than about 500 mTorr, 400 mTorr, 300 mTorr, 250 mTorr, and even no more than about 100 mTorr.

The laser desorption ionization probe can be a standard MALDI probe or an affinity capture probe. The affinity capture probe can have a "chromatographic adsorption surface" or a "biomolecule affinity surface". By "chromatographic adsorption surface" is intended a surface having an adsorbent capable of chromatographic discrimination among or separation of analytes. The phrase thus includes surfaces having anion exchange moieties, cation exchange moieties, reverse phase moieties, metal affinity capture moieties, and mixed-mode adsorbents, as such terms are understood in the chromatographic arts. By "biomolecule affinity surface" is intended a surface having an adsorbent comprising biomolecules or mimetics thereof capable of specific binding.

The methods of the present invention provide advantages for mass spectrometer analysis of a wide variety of biomolecules, including proteins, polypeptides, peptides, nucleic acids, lipids, and carbohydrates.

Prior to laser desorption/ionization in the analytical instruments and methods of the present invention, the probe to which the analyte is adherent is contacted with energy absorbing molecules.

"Energy absorbing molecules" and the equivalent acronym "EAM" refer to molecules that are capable, when adherent to a probe, of absorbing energy from a laser desorption ionization source and thereafter contributing to the desorption and ionization of analyte in contact therewith. The phrase includes all molecules so called in U.S. Pat. Nos. 5,719,060, 5,894,063, 6,020,208, and 6,027,942, the disclosures of which are incorporated herein by reference in their entireties. The phrase explicitly includes cinnamic acid derivatives, sinapinic acid ("SPA"), cyano hydroxy cinnamic acid ("CHCA") and dihydroxybenzoic acid.

It has previously been suggested that the composition of the energy absorbing molecules used to create a matrix/analyte cocrystal affects various parameters that may contribute to desorbed ion stability, such as the initial thermal energy and initial velocity. In addition, the present inventors have observed that impurities within a matrix/analyte cocrystal, such as extraneous metals, detergents, and salts, result in intensified unimolecular decay when compared with cocrystal systems devoid of these impurities.

The present inventors have discovered that combining a low melting point EAM with a molecule capable of scavenging alkali metals provides a surprisingly superior laser desorption ionization matrix. This proves particularly useful in orthogonal extraction mass spectrometry, which presents a more stringent requirement for ion stability than does parallel (axial) extraction MS, and especially useful when using affinity capture probes, which tend to create hotter ions than do standard MALDI probes.

Figure 5A:
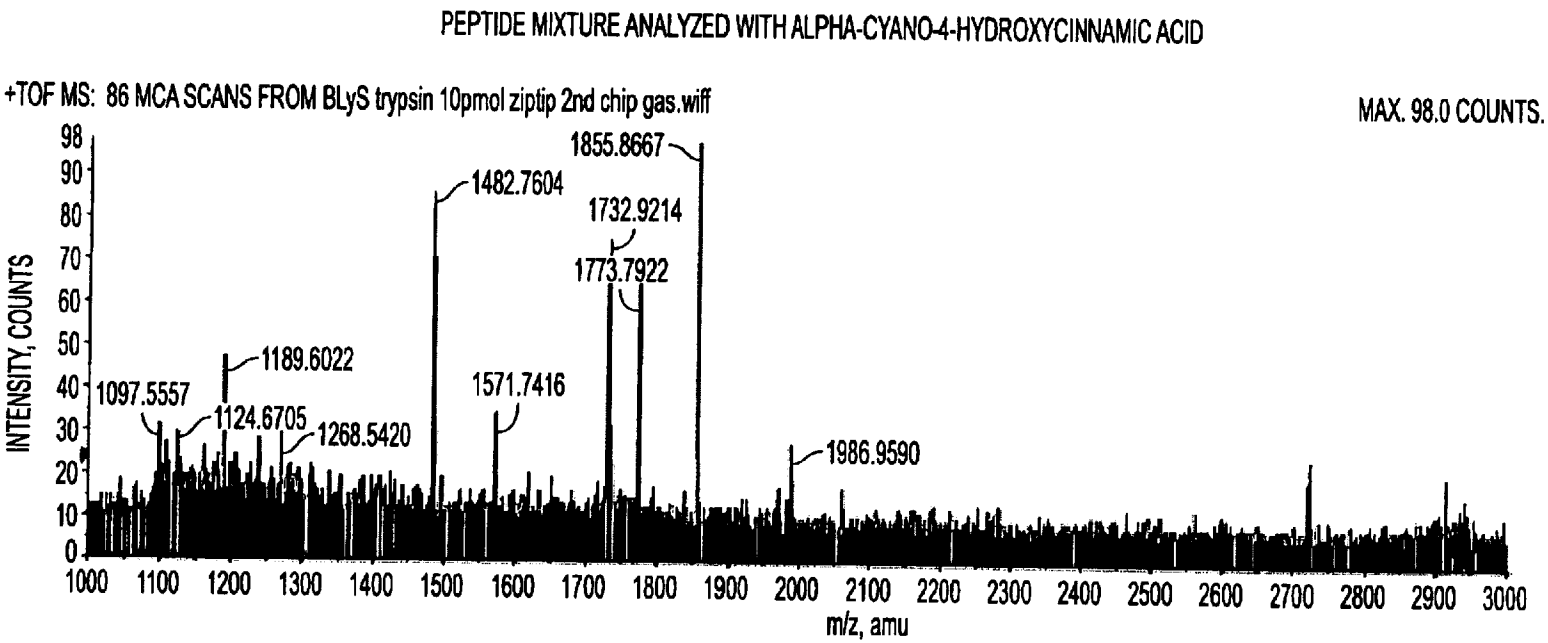
FIG. 5A is an OA-QqTOF MS scan of a peptide mixture in which α-cyano-4-hydroxycinnamic acid is used as a matrix.
Figure 5B:
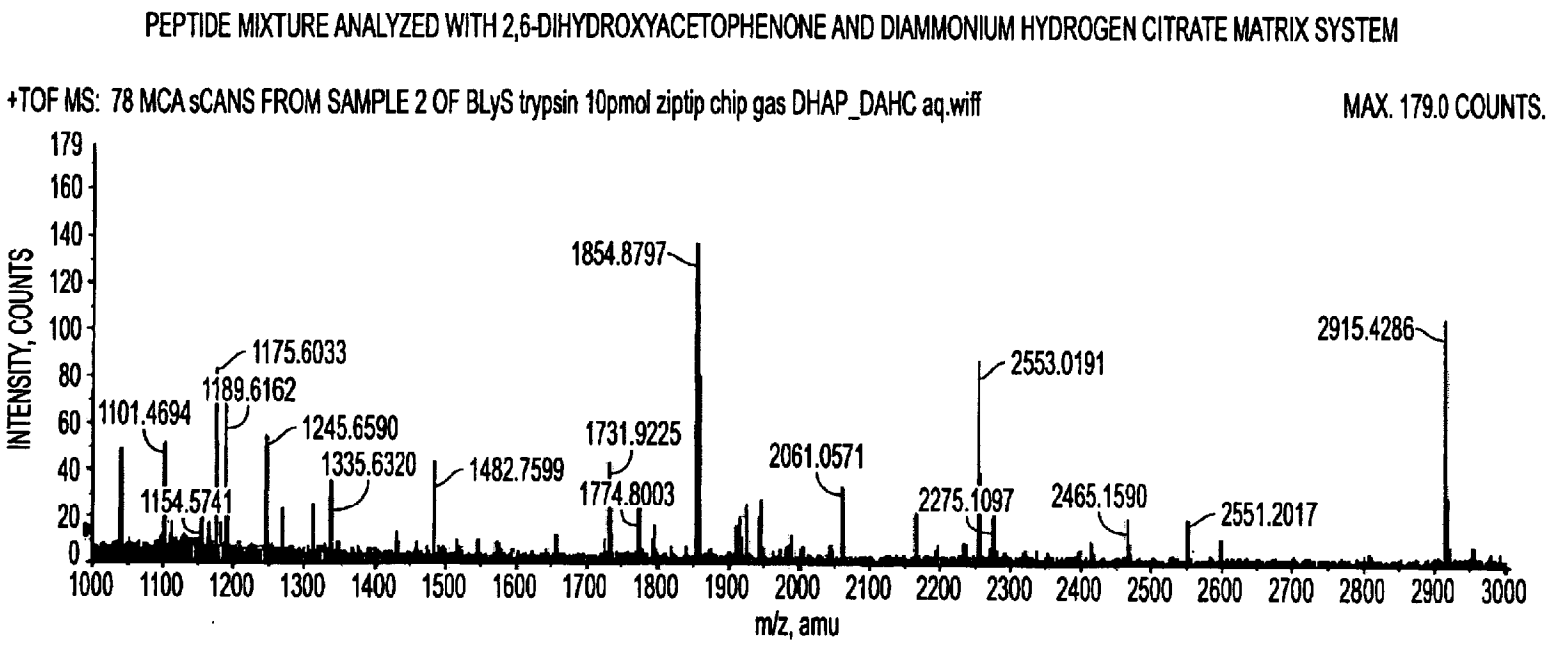
FIG. 5B is an OA-QqTOF MS scan of the same peptide mixture as analyzed in FIG. 4A, using a mixture of 2,6-dihydroxycinnamic acid and diammonium hydrogen citrate as a matrix, showing improved sensitivity.

FIG. 5A shows an OA-QqTOF scan of a labile peptide mixture adsorbed to an affinity capture probe and cocrystallized thereon with α-cyano-4-hydroxycinnamic acid, a standard EAM. FIG. 5B shows an OA-QqTOF scan of the same peptide mixture, adherent to a similar affinity capture probe, cocrystallized with a mixture of 2,6-dihydroxyacetophenone, a low melting point EAM, and diammonium hydrogen citrate. The improvement in sensitivity is readily apparent.

In a third aspect, therefore, the present invention provides methods of preparing an analyte for analysis by laser desorption ionization mass spectrometry, the method comprising: adsorbing analyte to an affinity capture laser desorption/ionization probe; and then cocrystallizing the analyte with (i) a low melting point energy absorbing molecule, and (ii) a molecule capable of scavenging alkali metals.

Table 1 presents the melting points and initial desorption velocities for several EAM matrices:

TABLE 1

Melting points, initial desorption velocity for bovine insulin, and observed unimolecular decay propensity for various MALDI matrices when analyzing peptides

| Matrix (EAM) | Melting Point (° C.) | Average Initial Velocity for Insulin (m/s) | Observed Unimolecular Decay |
|---|---|---|---|
| 2,6-Dihydroxyacetophenone | 156 | 353 | Low |
| 3,5-Dimethoxy-4-hydroxycinnamic acid | 203 | 332 | Intermediate |
| 2,5-Dihydroxybenzoic acid | 205 | 543 | Intermediate |
| Alpha-cyano-4-hydroxycinnamic acid | 240 | 291 | High |

Accordingly, in one embodiment of this aspect of the present invention, the EAM has a melting point of no more than about 210° C., thus excluding use of α-cyano-4-hydroxycinnamic acid. In further embodiments, the EAM has a melting point of no more than about 200° C., no more than about 190° C., no more than 180° C., no more than about 170° C., and even no more than about 160° C. In this latter embodiment, both 3,5-dimethoxy-4-hydroxycinnamic acid and 2,5-dihydroxybenzoic acid are excluded. In an embodiment that is at present preferred, the energy absorbing molecule is 2,6-dihydroxyacetophenone.

The cocrystal further includes an alkali metal scavenging agent, such as an ammonium salt of an organic acid.

At present particularly preferred is the use of diammonium hydrogen citrate in admixture with 2,6-dihyroxyacetophenone. This matrix consists of 100 mM 2,6-dihydroxyacetophenone in a solution of 50/50 water and acetonitrile mixed 10:1 with 1.0 M diammonium hydrogen citrate.

In a further aspect of the present invention, the improved matrix is combined with immediate post-source collisional cooling to provide an analytical method with increased sensitivity.

In this latter aspect of the invention, the method comprises: adsorbing the analyte to an affinity capture laser desorption/ionization probe; cocrystallizing the analyte with (i) a low melting point energy absorbing molecule, and (ii) a molecule capable of scavenging alkali metals; positioning the probe in interrogatable relationship to a laser desorption ionization source and concurrently for ion flow through an aperture of a bulkhead into a tandem mass spectrometer; introducing gas directly between the positioned probe and the tandem mass spectrometer; and then performing a mass spectrometric analysis on at least one of the introduced ions, or at least one fragment thereof.

All patents, patent publications, and other published references mentioned herein are hereby incorporated by reference in their entireties as if each had been individually and specifically incorporated by reference herein.

While specific examples have been provided, the above description is illustrative and not restrictive. Any one or more of the features of the previously described embodiments can be combined in any manner with one or more features of any other embodiments in the present invention. Furthermore, many variations of the invention will become apparent to those skilled in the art upon review of the specification. The scope of the invention should, therefore, be determined not with reference to the above description, but instead should be determined with reference to the appended claims along with their full scope of equivalents.

What is claimed is:

1. An analytical instrument, comprising:

a laser source;

a probe interface; and a tandem mass spectrometer, wherein said probe interface comprises a bulkhead having an aperture, a probe holder, and a gas inlet, wherein said probe interface is configured to position a laser desorption ionization probe, when said probe is engaged in the probe holder, in interrogatable relationship to said laser source and concurrently for ion flow through said bulkhead aperture into a first chamber of said tandem mass spectrometer, wherein said bulkhead presents a surface to the laser interrogated surface of the probe so positioned that the bulkhead surface and the probe surface are substantially parallel, wherein said gas inlet is located such that the gas enters the probe interface between the probe holder and the bulkhead, and wherein the bulkhead aperture is sized in relation to the gas flow entering the probe interface so as to permit equilibration of gas pressures between the probe interface and the first chamber of the tandem mass spectrometer.

2. The analytical instrument of claim 1, wherein said bulkhead is an electrostatic lens.

3. The analytical instrument of claim 1, wherein said probe holder is sealingly engaged to the bulkhead.

4. The analytical instrument of claim 3, wherein the sealing engagement of said probe holder to said bulkhead defines a space bounded by said probe holder, the laser interrogatable surface of said probe, when said probe is engaged in the probe holder, and said bulkhead, and wherein said gas inlet is located such that the gas enters said bounded space.

5. The analytical instrument of claim 4, wherein said tandem mass spectrometer is an orthogonal acceleration quadrupole-TOF MS.

6. The analytical instrument of claim 1 further comprising a probe engaged in the probe holder, wherein said probe is an affinity capture laser desorption ionization probe.

7. The analytical instrument of claim 1, wherein said tandem mass spectrometer is selected from the group consisting of a quadrupole-TOF MS, an ion trap MS, an ion trap TOE MS, a TOF-TOF MS, and a Fourier transform ion cyclotron resonance MS.

8. The analytical instrument of claim 7, wherein said tandem mass spectrometer is a quadrupole-TOF MS.

9. The analytical instrument of claim 8, wherein said quadrupole-TOF MS is an orthogonal acceleration quadrupole-TOF MS.

10. A method of analyzing an analyte in a tandem mass spectrometer, the method comprising the steps of:

desorbing and ionizing said analyte, the analyte being carried on a surface of a probe engaged in a probe holder;

introducing said desorbed analyte ions into the tandem mass spectrometer; and performing a mass spectrometric analysis on at least one of said introduced analyte ions, or at least one fragment thereof, wherein the probe holder is part of a probe interface that also comprises a gas inlet and a bulkhead having an aperture, and wherein (i) the probe interface positions the probe in interrogatable relationship to a laser source and concurrently for ion flow through the bulkhead aperture into a first chamber of said tandem mass spectrometer, (ii) said bulkhead presents a surface to the laser interrogated surface of the probe so positioned that the bulkhead surface and the probe surface are substantially parallel, (iii) gas introduced into the probe interface through the gas inlet enters between the probe holder and the bulkhead, and (iv) said bulkhead aperture is sized in relation to the as flow entering the robe interface so as to permit equilibration of gas pressures between said probe interface and the first chamber of said tandem mass spectrometer.

11. The method of claim 10, wherein said desorption and ionization is effected by the laser source.

12. The method of claim 11, further comprising the antecedent steps of:

positioning said probe in interrogatable relationship to said laser source and concurrently for ion flow through the bulkhead a aperture into the first chamber of said tandem mass spectrometer; and introducing gas into the probe interface by the gas inlet, whereby the gas enters between said probe holder and said bulkhead.

13. The method of claim 12, wherein said positioning comprises the steps of:

engaging said probe in the probe holder, and sealingly engaging said probe holder to the bulkhead.

14. The method of claim 10, wherein said tandem mass spectrometer is selected from the group consisting of a quadrupole-TOF MS, an ion trap MS, an ion trap TOF MS, a TOF-TOF MS, and a Fourier transform ion cyclotron resonance MS.

15. The method of claim 14, wherein said tandem mass spectrometer is a quadrupole-TOF MS.

16. The method of claim 15, wherein said quadrupole-TOF MS is an orthogonal acceleration quadrupole-TOF MS.

17. The method of claim 10, wherein said gas is selected from the group consisting of: atmospheric gas, conditioned atmospheric gas, nitrogen, and noble gases.

18. The method of claim 10, wherein said gas is introduced to a pressure of at least 1 milliTorr.

19. The method of claims 18, wherein said gas is introduced to a pressure no greater than 1 Torr.

20. The method of claim 19, wherein said gas is introduced to a pressure of about 10 milliTorr.

21. The method of any one of claims 10–20, wherein said laser desorption/ionization probe is an affinity capture probe.

22. The method of any one of claims 10–20, wherein said analyte is a protein, polypeptide, or peptide.

23. The method of any one of claims 10–20, wherein said laser desorption/ionization probe is an affinity capture probe and wherein said analyte is a protein, polypeptide or peptide.

* * * * *